US005432884A

United States Patent [19]

Kapanen et al.

[11] Patent Number: 5,432,884

[45] Date of Patent: Jul. 11, 1995

[54] METHOD AND APPARATUS FOR DECODING LPC-ENCODED SPEECH USING A MEDIAN FILTER MODIFICATION OF LPC FILTER FACTORS TO COMPENSATE FOR TRANSMISSION ERRORS

[75] Inventors: Pekka Kapanen; Yrjo Neuvo; Kari Jarvinen, all of Tampere, Finland

[73] Assignees: Nokia Mobile Phones Ltd., Salo; Nokia Telcommunications Oy, Espoo, both of Finland

[21] Appl. No.: 36,544

[22] Filed: Mar. 22, 1993

[30] Foreign Application Priority Data

Mar. 23, 1992 [FI] Finland ..... 921250

[51] Int. Cl.[6] ..... G10L 9/00

[52] U.S. Cl. ..... 395/2.37; 395/2.28

[58] Field of Search ..... 395/2.28, 2.29, 2.37, 395/2.42, 2.71, 2.35, 2.36, 2.2, 2.74, 2.76; 381/46, 41

[56] References Cited

U.S. PATENT DOCUMENTS

| | | | |
|---|---|---|---|
| 4,224,689 | 9/1980 | Sundberg | 371/6 |
| 4,587,620 | 5/1986 | Niimi et al. | 364/574 |
| 4,625,240 | 11/1986 | Yablonski et al. | 358/143 |
| 4,682,230 | 7/1987 | Perlman et al. | 358/167 |
| 4,688,224 | 8/1987 | Dal Degan et al. | 381/46 |
| 4,809,331 | 2/1989 | Holmes | 381/41 |
| 4,843,615 | 6/1989 | Davis | 375/80 |
| 4,882,737 | 11/1989 | Dzung | 375/15 |
| 4,906,928 | 3/1990 | Gard | 324/240 |
| 4,907,277 | 3/1990 | Callens et al. | 395/2.37 |
| 4,910,467 | 3/1990 | Leitch | 329/306 |
| 4,928,258 | 5/1990 | May | 364/724.17 |
| 5,012,519 | 4/1991 | Adlersberg et al. | 381/47 |
| 5,025,404 | 6/1991 | Janssen et al. | 364/723 |
| 5,097,507 | 3/1992 | Zinser et al. | 381/31 |
| 5,142,551 | 8/1992 | Borth et al. | 375/7 |
| 5,148,487 | 9/1992 | Nagai et al. | 381/46 |
| 5,235,424 | 8/1993 | Wagner et al. | 358/174 |
| 5,271,042 | 12/1993 | Borth et al. | 375/101 |
| 5,285,480 | 2/1994 | Chennakeshu et al. | 375/101 |
| 5,305,332 | 4/1994 | Ozawa | 381/46 |

FOREIGN PATENT DOCUMENTS

| | | | |
|---|---|---|---|
| 0195487A1 | 9/1986 | European Pat. Off. | G10L 9/14 |
| 0379296A2 | 7/1990 | European Pat. Off. | G10L 9/14 |
| 0386985 | 9/1990 | European Pat. Off. . | |
| 3922972A1 | 7/1989 | Germany . | |
| 62-059420 | 2/1987 | Japan . | |
| 2243733 | 11/1991 | United Kingdom . | |
| 921250 | 11/1992 | United Kingdom . | |
| WO89/02148 | 3/1989 | WIPO | G10L 9/14 |

OTHER PUBLICATIONS

T. Parsons, *Voice and Speech Processing*, McGraw-Hill, New York, N.Y., 1987, pp. 228-244.

P. Haavisto et al., "Median Based Idempotent Filters," J. of Circuits, Systems, and Computers, 1(2):125-148, 1991.

N. S. Jayant, "Average-and Median-Based Smoothing Techniques for Improving Digital Speech Quality in (List continued on next page.)

*Primary Examiner*—Allen R. MacDonald
*Assistant Examiner*—Michael A. Sartori
*Attorney, Agent, or Firm*—Perman & Green

[57] ABSTRACT

Disclosed herein are methods and apparatus for improving the quality of synthesized speech that is transmitted through a channel that is susceptible to transmission errors. In a presently preferred embodiment of the invention a speech signal is assumed to be first encoded using a Linear Predictive Coding (LPC) technique prior to transmission. The parameters that describe the short-term spectral behavior of the speech signal are received and then applied to and processed by a non-linear median processing block only on an occurrence of a predetermined number of transmission errors in the received LPC speech signal. The median-processed short term speech parameters are subsequently employed, together with a received excitation signal, in a synthesis filter to synthesize a speech signal of improved quality over what would be obtained if the short term speech parameters were not median processed to compensate for the transmission errors.

8 Claims, 3 Drawing Sheets

OTHER PUBLICATIONS the Presence of Transmission Errors," *IEEE Trans. on Communications,* vol. COM-24, Sep. 1976, pp. 1043-1045.

T. A. Nodes and N. C. Gallagher, "Median Filters: Some Modications and Their Properties", IEEE Transon Acoust., Speech, Signal Proc, vol. ASSP-30, Oct. 1982, pp. 739-746.

Astola, J. et al., "Vector Median Filters", *Proceedings of IEEE,* vol. 78, No. 4, Apr. 1990, pp. 678-689.

"A Theoretical Analysis of the Properties of Median Filters", N. Gallagher, IEEE Transactions on Acoustics, Speech, and Signal Processing, vol. ASSP-29, No. 6, Dec. 1981, pp. 1136-1141.

"Fir-Median Hybrid Filters", P. Heinonen, IEEE Trans. on Acoustic, Speech and Signal Processing, vol. ASSP-35, No. 6, Jun. 1987, pp. 832-838.

"Performance of Digital Matched Filter Correlator with Unknown Interference", C. Cahn, IEEE Trans. on Communication Technology, Dec. 1971, pp. 1163-1172.

EPO Search Report for App. No. 93305141.9.

METHOD AND APPARATUS FOR DECODING LPC-ENCODED SPEECH USING A MEDIAN FILTER MODIFICATION OF LPC FILTER FACTORS TO COMPENSATE FOR TRANSMISSION ERRORS

The present invention relates to a method of and an apparatus for speech coding.

BACKGROUND OF THE INVENTION

Linear predictive coding (LPC) is a well-known and widely used method of speech coding. A known (LPC) technique is described below with reference to FIG. 1 of the accompanying drawings, which shows a known LPC encoder.

FIG. 1 is a block diagram of a known speech signal encoder, which utilizes linear predictive coding. The Incoming signal s(n) 100 is processed block by block in the encoder. The length N of the block is generally selected to be about 10 to 30 msec. The sampling frequency of speech signal 100 is generally 8 kHz, whereby a performance number in the order of 8 to 12 is obtained which is sufficient for the linear predictive coding model. The LPC parameters, which are indicative of the filter factors, are calculated for each block of the speech signal 100 in LPC analyzer 103. They can be factors $a_i$; $i=1, 2, \ldots, P$ of a direct-form filter type, where P is the prediction order used in the LPC model. The filters of the LPC model are often realized using a framework filter, for which the direct-form filter factors are converted into so-called reflection coefficients $r_{ci}$, $i=1, 2, \ldots, P$. The calculated filter factors are quantized and introduced to block 106 which carries out the multiplexing and error correction encoding.

Speech signal 100 to be encoded is introduced to the analysis filter 101 in such a way that each block of the speech signal 100 is filtered in analysis filter 101 by using those filter factor values that were calculated in the related block in the LPC analyzer 103. Quantized filter factors are employed in analysis filter 101 (even though unquantized values are available) in order to make its operation the reverse of that applied in the synthesis filtering used in decoding. The output of quantization block 104 is transferred to the dequantization block 105 and to analysis filter 101 to be used as filter factors. A so-called prediction error is obtained as an output of analysis filter 101 for each portion of the speech signal 100. This prediction error signal is quantized using quantizer 102 and it is also Introduced to multiplexer 106 to be transmitted to the telecommunications channel 107.

Several coding methods can be utilized depending on how the prediction error of the LPC model is transmitted to the decoder. When quantizing each sample separately of a prediction error, this is known as the Residual Excited Predictive Coding (REPC), see, for instance, U.S. Pat. No. 4,220,819. The most effective linear predictive coding methods employ the so-called analysis-synthesis technique, where a suitable quantized presentation is located for the prediction error by carrying out a synthesis of the speech signal in the encoder through different excitation options, i.e., quantized error signals, and by selecting the excitation which produces the best synthesis result for transmission to the decoder.

When searching for a representation for the prediction error which contains sample values which deviate from zero only by a small number of samples using the analysis-by-synthesis search, this is known as Multi Pulse Coding (MPC), see, for instance, U.S. Pat. No. 4 472 832. The Code Excited Linear Prediction (CELP), see, for instance, U.S. Pat. No. 4,817,152 employes, in turn, a vector presentation from each prediction error block, whereby the excitation optimized with the aid of the analysis-by-synthesis techniques may include a large number of non-zero sample values, the number of different excitation combinations being limited, at the same time, to the small number required by the low transmission rate, however.

The quality of the speech signal transmitted using LPC methods decreases considerably, if transmission errors occur in the transmission channel, especially in noisy channels such as those used in mobile radio communications. It is essential that the coding method used can overcome transmission errors as efficiently as possible if the best possible quality is to be achieved for the speech signal. It is possible to protect the coded speech signal against transmission errors by using a special error correction coding. In this case, in addition to parameters presenting the speech signal, additional bits used in error correction are transmitted to the receiver. However, the transmission of such additional error correction information decreases the number of bits available for the actual speech coding and thus increases the distortion of the speech signal caused by the speech coding itself. On the other hand, all the transmitted coding parameters cannot be effectively protected by the error correction coding.

Thus it would be desirable to achieve a decrease in the effect of the transmission errors which are caused by the coding parameters themselves especially if that decrease could be implemented without transmitting the additional information which decreases the channel capacity. This decrease in the effects of the transmission errors could either act as such or in combination with separate error correction coding.

SUMMARY OF THE INVENTION

According to a first aspect of the present invention there is provided a method of speech coding utilizing linear predictive coding (LPC), comprising demultiplexing and dequantizing a received signal comprising a speech information signal and LPC parameters which contain Information indicative of the number of transmission errors in the signal, and synthesizing a speech signal from the received speech information signal in a synthesis filter, wherein the operation of the synthesis filter is controlled by filter factors produced from the LPC parameters, characterized in that the filter factors are monitored to determine whether the number of transmission errors is above a predetermined value whereupon non-linear modification of the filter factors is effected to produce a modified filter factor, in order to compensate for transmission errors, prior to the modified filter factors being forwarded to the synthesis filter.

According to a second aspect of the present invention there is provided a speech decoder utilizing linear predictive coding (LPC), comprising means for demultiplexing and dequantizing a received signal comprising a speech information signal and LPC parameters which contain information indicative of the number of transmission errors in the signal, and synthesizing a speech signal from the received speech information signal in a synthesis filter, wherein the operation of the synthesis filter Is controlled by filter factors produced from the LPC parameters, characterized by a non-linear modifying block in which the filter factors are monitored to determine whether the number of transmission errors is above a predetermined value whereupon non-linear modification of the filter factors is effected to produce a modified filter factor, in order to compensate for transmission errors, prior to the modified filter factors being forwarded to the synthesis filter.

An advantage of the present invention is an improvement in the quality of a speech signal in conjunction with linear predictive coding, which overcomes the above described drawbacks and problems.

BRIEF DESCRIPTION OF THE DRAWINGS

A method in accordance with the invention can be applied to all coders using the LPC modelling where the predictive factors of the model are transmitted to the receiver in a transmission channel which suffers transmission errors.

An embodiment of the invention is described below, by way of example, with reference to the accompanying drawings, in which.

DETAILED DESCRIPTION OF THE INVENTION

Figure 1:
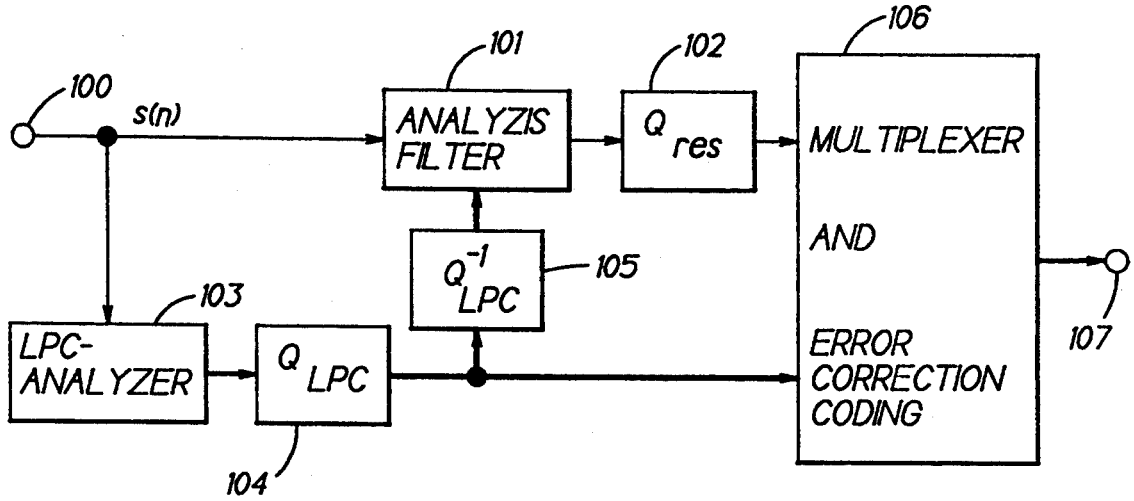
FIG. 1 Prior Art
FIG. 1 is a block diagram of a known speech signal encoder based on linear prediction.
Figure 2:
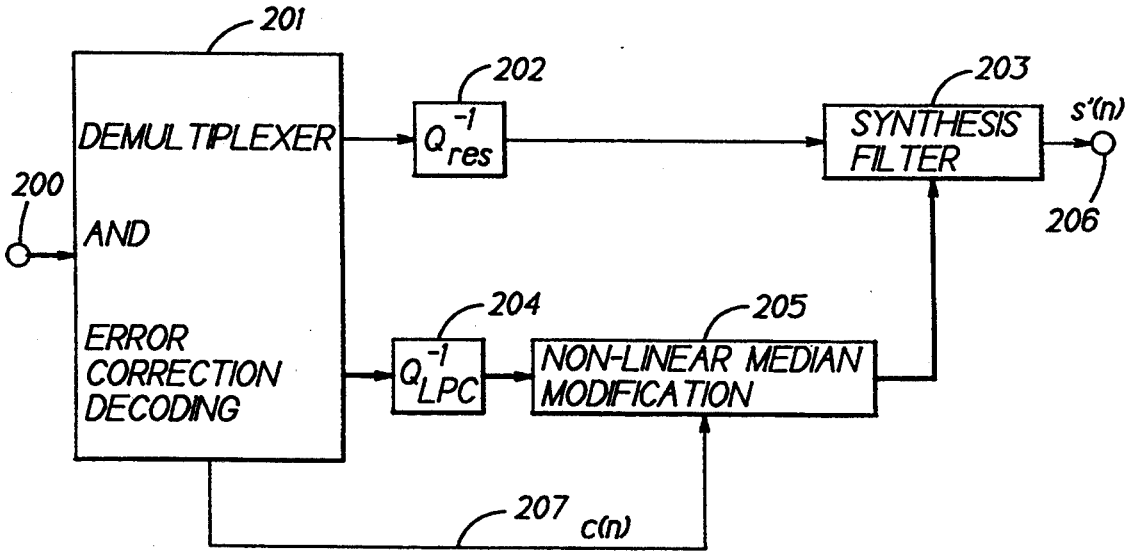
FIG. 2 is a block diagram of a decoder in accordance with the invention.

FIG. 2 is a block diagram of a decoder in accordance with the invention. The decoder utilizes non-linear modification of its function unlike prior art decoders based on linear prediction. In the decoding part of the prior art coders based on linear prediction, the functions performed are the reverse of those performed for encoding, as presented in FIG. 1.

Different coding parameters are demultiplexed from the bit stream transmitted to the decoder and dequantized. The speech signal is synthesized in the decoder by using a synthesis filter which is the reverse of the analysis filter in the encoder. The dequantized prediction error signal is used as an excitation to the synthesis filter the factors of which are provided by dequantizing the transmitted prediction factors. A synthesized speech signal is obtained from the output of the synthesis filter.

The bit stream 200 received in the decoder in accordance with the present invention is provided to demultiplexer 201. The LPC parameter presentation obtained from the demultiplexer 201 is dequantized in dequantizer 204. The LPC parameters are forwarded to the modifying block 205, from where the received, processed parameter values are forwarded to the synthesis filter 203 as factors. In addition to the LPC parameters, a prediction error signal is obtained from demultiplexer 201 and it is dequantized in dequantizer 202 and taken to the synthesis filter 203 as an excitation. Decoded speech signal s'(n) is obtained from output 206 of synthesis filter 203.

When the modifying block 205 in accordance with the invention is used, the effect on the quality of the speech signal which is synthesized in the decoder due to transmission errors produced in the spectrum parameters during can be decreased. With the aid of the non-linear modification the parameters containing transmission errors can thus be used in the synthesis filtering to produce a high-quality speech signal.

The operation of modifying block 205 is controlled by the information on the number of the transmission errors on the channel, which is obtained from the error correction decoding. This information is conveyed over signal line 207. Shaping or modifying block 205 is activated only if the number of transmission errors in the spectrum parameters is substantial. The modifying operation is not carried out, i.e., the dequantized LPC parameters are taken directly to synthesis filter 203 for further use, provided that the transmission connection is faultless or its errors in the LPC parameters do not essentially decrease the quality of the speech signal.

The operation of modifying block 205 is based on the identification of values containing transmission errors and on replacing them with usable values with the aid of the median operation. The shaping is carried out with the aid of the LPC parameter values of several consecutive speech frames and this procedure is described more closely in the subsequent exemplary embodiments.

Median operations per se are described, for instance, in publications like J. Astola, P. Heinonen, Y. Neuvo, "Vector Median Filters", Proc. IEEE, Vol. 78, No. 4, April 1990, pages 678–689, and P. Haavisto, M. Gabbouj, Y. Neuvo, "Median Based Idempotent Filters", Journal of Circuits and Systems and Computers, Vol. 1, No. 2, 1991, pages 125–148.

By using the method on the LPC parameters the number of frames classified as faulty can be decreased and thus the faulty frames rarely need to be replaced using a separate replacement procedure.

The method does not require the transmission of additional error correcting Information, whereby it does not cause load on the transmission capacity. Consequently, the method is easy to connect to speech coders based on the linear prediction by implementing it in the decoding part of the LPC parameters, as illustrated in FIG. 2.

Figure 3:
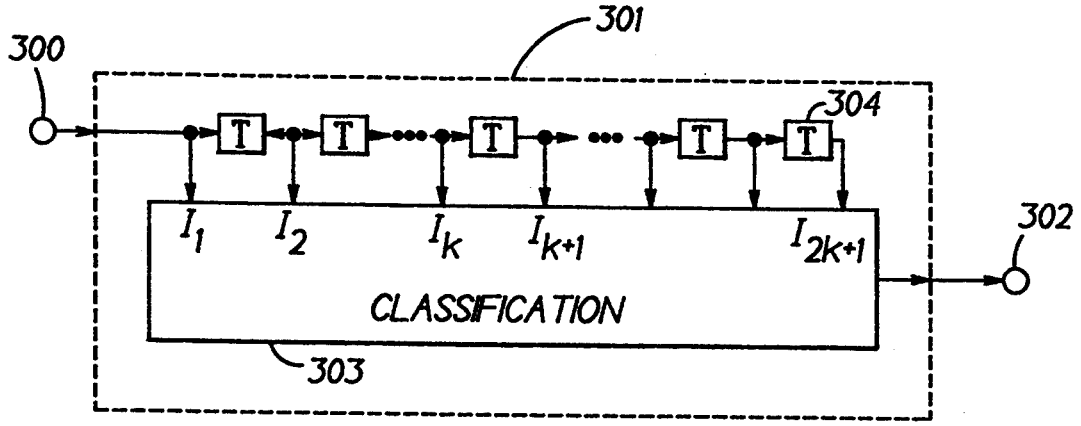
FIG. 3 is a block diagram of a non-linear modifying block of the speech decoder in accordance with the invention.

FIG. 3 is a block diagram of the non-linear modifying block of the speech coder in accordance with the invention. The processing is based on a median operation. The LPC parameter information obtained from the dequantizer is taken to input 300 of shaping block 301. A classification operation is carried out between the N consecutive parameter values of each LPC parameter. Classification block 303 provides as its output 302 the median value of said N input values of classifier 303, i.e., where $N=2k+1$, the output 302 will be the $(k+1)$th largest value of the values of the classifier's inputs $I_1, I_2, \ldots, I_{2k+1}$. The non-linear processing according to the figure is carried out in parallel and separately for each LPC factor transmitted in the transmission channel. It should be noted that unit delay symbols 304 refer to the counting rate of the LPC parameters and not to the sampling rate of the speech signal.

Figure 4:
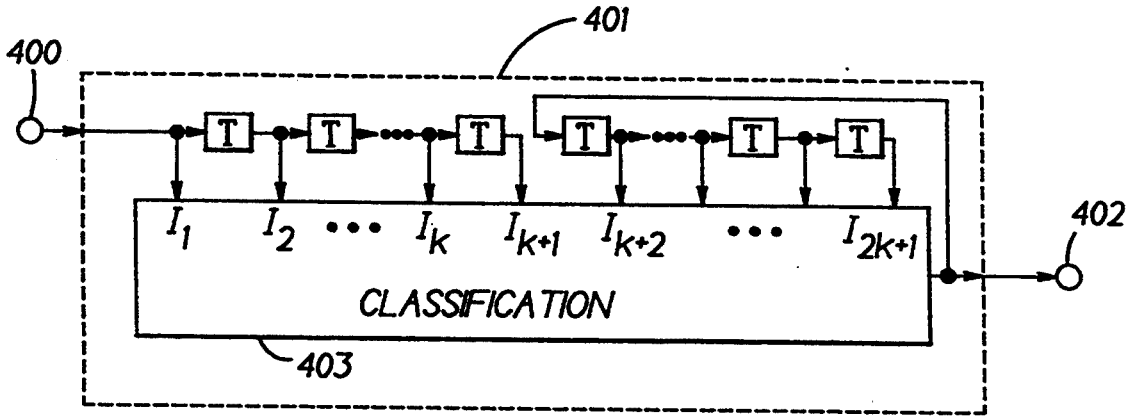
FIG. 4 illustrates an alternative implementation of the non-linear modifying block of the speech decoder in accordance with the invention.

FIG. 4 presents an alternative implementation of the non-linear modifying block of the speech coder in accordance with the invention. The process is based on recursive median operation. Thus output 402 of classifier 403 is further taken to classifying block 403 to be processed. The LPC parameter value to be processed is taken to input 400 of shaping block 401. In the recursive processing preceding output value 402 of classifier 403 (and not the preceding value of the (k+1)th input of classifier 403) is taken to the (k+2)th input, as viewed from input 400 of shaping block 401, i.e., from the left of the inputs of the classification device.

The operation of modifying block 401 can be enhanced by the recursive processing, whereby a short classifying operation can be used so that the delay caused by the modification remains proportional. Even in this case the processing is carried out separately for each LPC parameter. A good modification result is achieved even with the classification operation of three Inputs in the decoder. The recursive processing also makes it possible to keep low the calculatory loading caused by the modification.

The calculatory loading caused by the method can be further decreased by carrying out the processing of only the most important values of the LPC parameter vector in modifying block 401, i.e., by processing only those LPC parameters that describe the dependence to the closest sample values of the speech signal and by transmitting the other LPC parameters to the synthesis filters without modifying them. When using 8-degree modelling, for instance, nearly as good a result is achieved by processing the three or four lowest LPC parameters in modifying block 401 as by processing each of the eight parameters.

Figure 5:
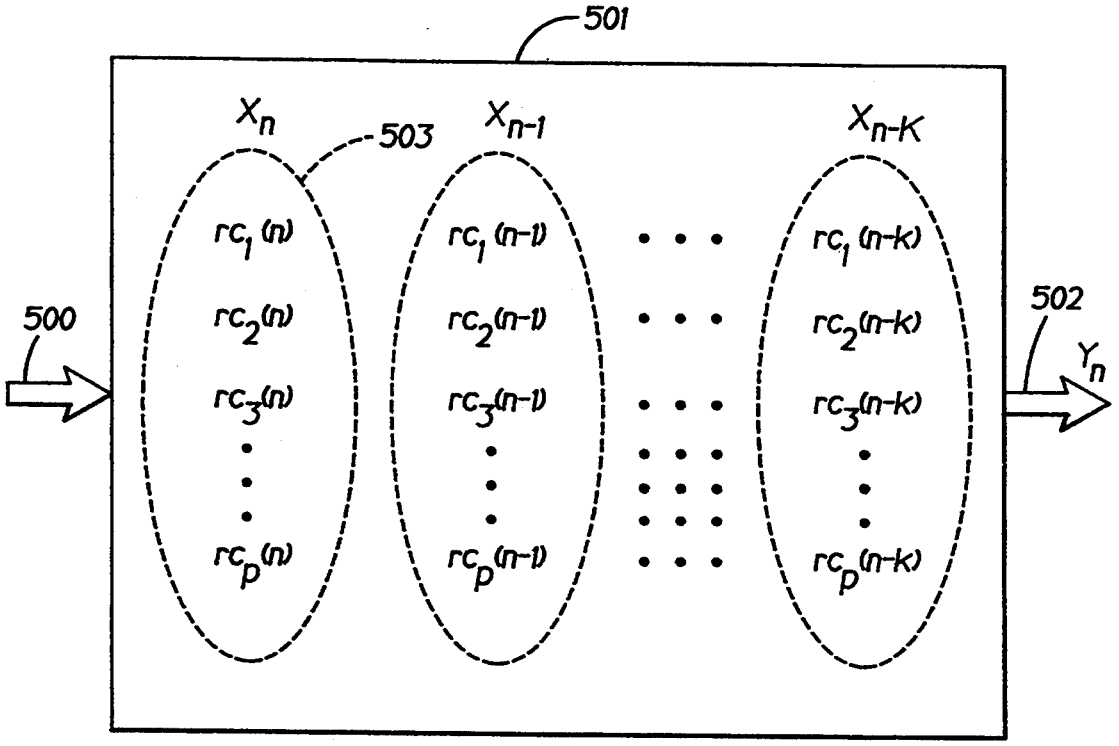
FIG. 5 illustrates the operation of a vector type non-linear modifying block in accordance with the invention.

FIG. 5 presents a block diagram of the non-linear modifying block of the vector type according to the invention. The modifying method implements the vector processing of the LPC parameters. Since the prediction factors are a set of parameters which are simultaneously calculated for each block of the input signal, they are inherently of the vector type. Prediction vector $X_n$ can be formed in a straightforward manner in each frame n. This vector contains, for instance, when a reflection factor presentation is used, reflection factor values $(rc_1(n), rc_2(n), \ldots, rc_p(n)), \ldots, rc_p(n))$.

Each set of parameters is processed as a vector which is taken to input 500 of vector shaping block 501. From the point of view of speech, a higher quality of speech quality is obtained in the channel containing transmission errors by taking the processed reflection factor values contained In vector Yn of output 502 of modifying block 501 to the synthesis filter than would be obtained by the direct use of the dequantized reflection factor vector Xn 503.

In the vector shaping the output vector is formed with the aid of reflection factor vector $X_n, X_{n-1}, \ldots, X_{n-k}$ by carrying out a vector median operation. The vector median operation is carried out by calculating the distance of each vector $X_i$ to the other K vectors and by locating the vector which provides the minimum distance to the others. The distance of the vectors is calculated as the sum of the distances of the vectors' components. The distance measurements can be weighted in such a way that the lowest components of the reflection factor vector are made more significant than the higher ones. The vector median operation can also be carried out recursively by including the preceding output vector of modifying block 501 in the input of the classifier.

The method in accordance with the invention can be utilized in all methods using the linear prediction, i.e., the linear predictive coding methods. By using the non-linear modifying method in accordance with the Invention the likelihood of an interruption in the speech signal is decreased.

With the aid of the modifying method in accordance with the invention, the predictive factors according to the LPC model can be used in synthesizing the speech signal even when they still contain a substantial number of transmission errors. A bit stream which is otherwise classified as useless can be utilized with the aid of the invention in synthesizing the speech signal In the receiver.

In view of the foregoing it will be obvious to a person skilled in the art that modifications may be incorporated without departing from the scope of the present invention.

We claim:

1. A method for improving the quality of a synthesized speech signal that is obtained from a decoder that operates on a Linear Predictive Coded (LPC) speech signal, comprising the steps of:

receiving a LPC speech signal through a transmission channel that is susceptible to transmission errors;

demultiplexing and dequantizing the received LPC speech signal to obtain an excitation signal and also a set of LPC filter factors that specify a short term spectral behavior of the LPC speech signal;

generating a status signal that indicates a number of transmission errors that are occurring in the transmission channel; and synthesizing a speech signal from the excitation signal in cooperation with the set of LPC filter factors, wherein the step of synthesizing includes the steps of monitoring the status signal to detect a condition wherein the number of transmission errors exceeds a threshold number and, in response to the threshold number being exceeded, modifying the set of LPC filter factors prior to synthesizing the speech signal, wherein the step of modifying includes a step of performing a non-linear median filtering operation on the LPC filter factors.

2. A method as claimed in claim 1, wherein the step of performing a non-linear median filtering operation comprises the step of processing K+1 most recently received sets of filter factors by a median filtering operation such that a most recently received set of P filter factors $a_i$, where $i=1, \ldots, P$, is processed together with K most recently received sets of filter factors, each K+1 most recently received sets of filter factors comprising P filter factors, to produce a modified set of median filtered LPC filter factors for use during the step of synthesizing a speech signal, wherein P is a LPC prediction order having an integer value equal to or greater than one, and wherein K is an even integer that is greater than zero.

3. A method as set forth in claim 2, wherein the step of performing a non-linear median filtering operation comprises the step of performing a recursive median filtering operation, wherein each of the modified P filter factors that is produced for the most recently received sets of P filter factors is employed for median filtering a next set of received P filter factors.

4. A method as set forth in claim 1, wherein the step of performing a non-linear median filtering operation comprises the step of median filtering (K+1) vectors comprised of a most recently received set of P filter factors $a_i$, where $i=1, \ldots, P$, and K previous most recently received sets of P filter factors, wherein each of the (K+1) vectors has a dimension of P and contains a set of P filter factors, and including the steps of:

determining a distance of each of the (K+1) vectors to all other K vectors;

selecting as an output vector one of the (K+1) vectors that is determined to have a minimum distance to all other K vectors; and selecting the P filter factors contained in the selected output vector to be a set of modified LPC filter factors for use during the step of synthesizing a speech signal, wherein P is a LPC prediction order having an integer value equal to or greater than one, and wherein K is an even integer that is greater than zero.

5. A speech decoder that operates on a Linear Predictive Coded (LPC) speech signal, comprising:

means for receiving a LPC speech signal through a transmission channel that is susceptible to transmission errors;

means for demultiplexing and dequantizing the received LPC speech signal to obtain an excitation signal and also a set of LPC filter factors that specify a short term spectral behavior of the LPC speech signal;

means for synthesizing a speech signal from the excitation signal in cooperation with the set of LPC filter factors;

means for generating a status signal that indicates a number of transmission errors that are occurring in the transmission channel;

means for monitoring the status signal to detect a condition wherein the number of transmission errors exceeds a threshold number; and means, responsive to said monitoring means indicating that the threshold number is exceeded, for modifying the set of LPC filter factors by performing a non-linear median filtering operation on the LPC filter factors.

6. A speech decoder as claimed in claim 5, wherein said modifying means includes means for processing K+1 most recently received sets of filter factors by a median filtering operation such that a most recently received set of P filter factors $a_i$, where $i=1, \ldots, P$, is processed together with K most recently received sets of filter factors, each K+1 most recently received sets of filter factors comprising P filter factors, to produce a modified set of median filtered LPC filter factors for use by said means for synthesizing a speech signal, wherein P is a LPC prediction order having an integer value equal to or greater than one, and wherein K is an even integer that is greater than zero.

7. A speech decoder as set forth in claim 6, wherein said modifying means includes means for performing a recursive median filtering operation, wherein each of the modified P filter factors that is produced for the most recently received sets of P filter factors are employed for median filtering a next set of received P filter factors.

8. A speech decoder as set forth in claim 5, wherein said modifying means comprises:

means for median filtering (K+1) vectors comprised of a most recently received set of P filter factors $a_i$, where $i=1, \ldots, P$, and K previous most recently received sets of P filter factors, wherein each of the (K+1) vectors has a dimension of P and contains a set of P filter factors;

means for determining a distance of each of the (K+1) vectors to all other (K+1) vectors;

means for selecting as an output vector one of the (K+1) vectors that is determined to have a minimum distance to all other (K+1) vectors; and means for selecting the P filter factors contained in the selected output vector to be a set of modified LPC filter factors for use by said means for synthesizing a speech signal, wherein P is a LPC prediction order having an integer value equal to or greater than one, and wherein K is an even integer that is greater than zero.

* * * * *